United States Patent [19]

Hayashi et al.

[11] 4,177,133

[45] * Dec. 4, 1979

[54] PROCESS FOR PRODUCING HIGH-CRYSTALLINE PETROLEUM COKE

[75] Inventors: Kiyoshige Hayashi, Tokyo; Mikio Nakaniwa, Ohme; Nobuyuki Kobayashi, Ichihara; Minoru Yamamoto, Ichichara; Yoshihiko Hase, Ichihara, all of Japan

[73] Assignee: Maruzen Petrochemical Co., Ltd., Tokyo, Japan

[ * ] Notice: The portion of the term of this patent subsequent to Sep. 20, 1994, has been disclaimed.

[21] Appl. No.: 924,804

[22] Filed: Jul. 14, 1978

Related U.S. Application Data

[63] Continuation of Ser. No. 787,305, Apr. 14, 1977, abandoned, which is a continuation-in-part of Ser. No. 613,541, Sep. 15, 1975, Pat. No. 4,049,538.

[30] Foreign Application Priority Data

Sep. 25, 1974 [JP] Japan ..... 49/110316

[51] Int. Cl.[2] ..... C10G 9/14

[52] U.S. Cl. ..... 208/50; 208/131

[58] Field of Search ..... 208/50, 106, 131

[56] References Cited

U.S. PATENT DOCUMENTS

| | | | |
|---|---|---|---|
| 2,271,097 | 1/1942 | Ruthruff et al. | 208/50 |
| 2,922,755 | 1/1960 | Hackley | 208/106 |
| 3,472,761 | 10/1969 | Cameron | 208/131 |
| 3,547,804 | 12/1970 | Noguchi et al. | 208/131 |
| 4,049,538 | 9/1977 | Hayashi et al. | 208/131 |

*Primary Examiner*—Herbert Levine

*Attorney, Agent, or Firm*—Larson, Taylor and Hinds

[57] ABSTRACT

A high-crystalline petroleum coke is produced from low-sulfur petroleum feedstock such as virgin crude oil, distillation residuum and cracked residuum by subjecting the feedstock to preheat treatment under specific conditions to effect cracking and soaking thereof, subjecting the preheat-treated feedstock to flash distillation to remove non-crystalline substances contained therein as pitch and to recover distillate, fractionating the distillate to provide a heavy residue and subjecting the heavy residue to a delayed coking under specific conditions to produce the desired coke which has a coefficient of thermal expansion of less than $1.0\times10^{-6}$/° C. over 100°–400° C.

10 Claims, 1 Drawing Figure

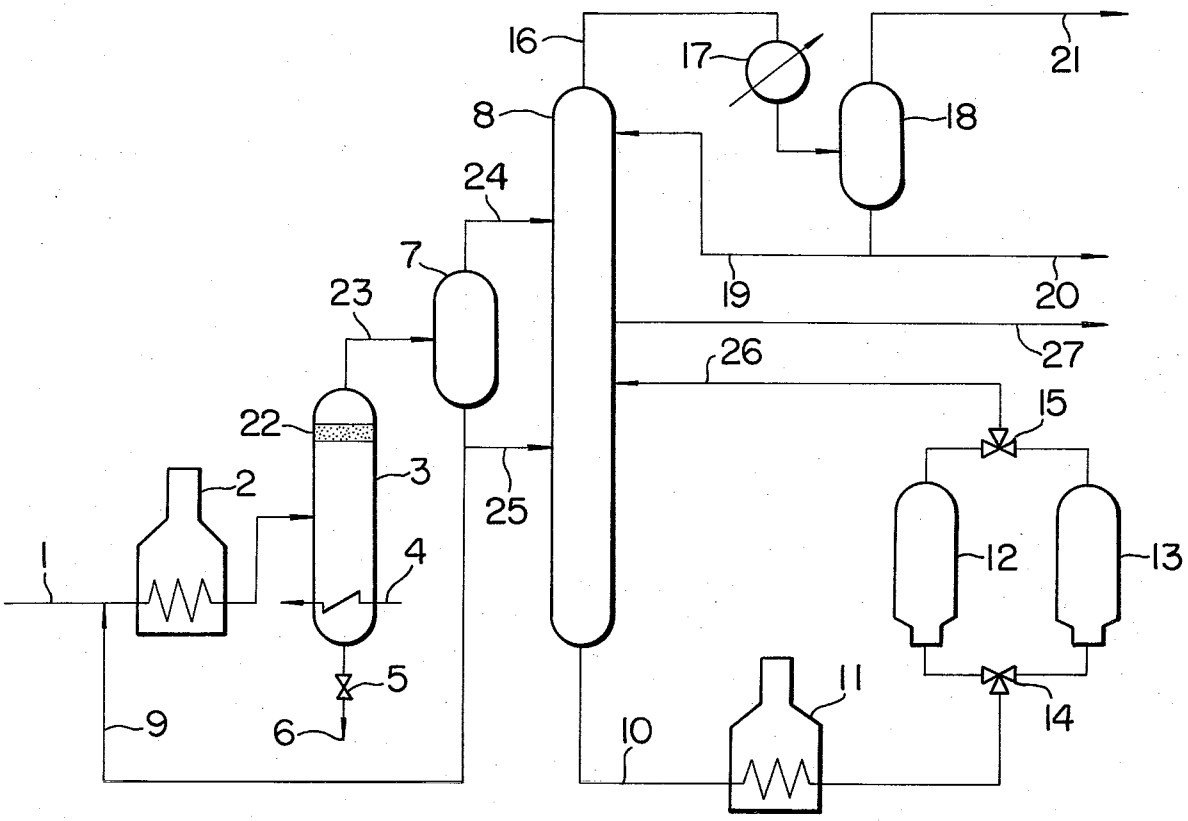
1
2
3
4
5
6
7
8
9
10
11
12
13
14
15
16
17
18
19
20
21
22
23
24
25
26
27

PROCESS FOR PRODUCING HIGH-CRYSTALLINE PETROLEUM COKE

RELATED APPLICATIONS

This application is a continuation of application Ser. No. 787,305 filed Apr. 14, 1977 now abandoned, which is, in turn, a continuation-in-part of Ser. No. 613,541, filed Sept. 15, 1975 now U.S. Pat. No. 4,049,538.

BACKGROUND OF THE INVENTION

This invention relates to a process for the production of a high-crystalline petroleum coke by treating in a delayed coking manner a feedstock of petroleum origin including a low-sulfur, virgin crude oil, a low-sulfur distillation or cracked residuum and a hydrodesulfurized residuum of distillation or cracking.

There have already been proposed various processes for producing a premium grade petroleum coke from a virgin crude oil, topped residue or vacuum residue and the cokes thus obtained have, in principle, been suited for the purpose of the production of graphite electrodes. At present, however, with the rapid progress of electric furnace smelting, requirement for the quality of premium grade coke is becoming more severe. Furthermore, the progress of steel-making technique using iron pellets and of electric furnace method essentially requires higher quality synthetic graphite electrodes suited for ultrahigh power electric furnace steel-making, for which purpose such a higher quality of petroleum coke will be most suitable as material. Therefore, the development of new technique for producing a petroleum coke of higher quality than that of commercially available premium grade coke, which is suited for large-scale operation in a simple manner with high reproducibility at reasonable costs, has been eagerly desired in the art. For convenience sake, such a higher quality coke than the premium grade one is called hereinafter high-crystalline coke in view of its textural appearance being more highly crystalline than premium grade one.

It is well-known that the quality or performance of synthetic graphite electrodes depends largely upon the graphitizability of coke from which the electrodes are made. Thus, the higher the crystallinity of coke, the higher the graphitizability thereof and there are several factors, such as coefficient of thermal expansion (CTE), degree of graphitization (h/w), real density, electric resistivity and others, as measures of evaluating the quality of coke. In general, the better the quality of coke, the lower the value of CTE, the higher the value of h/w, the higher the real density and the lower the electric resistivity thereof.

Typical properties of various grades of coke are shown in Table 1.

TABLE 1

| | Coefficient of thermal expansion(1) (CTE) over 100–400° C. ($\times 10^{-6}$/°C.) | Degree of graphitization(2) h/w | Real density(3) at 1400° C. | Coefficient of cubic expansion(4) over 130–300° C. (x $10^{-6}$/°C.) |
|---|---|---|---|---|
| Non-crystalline coke | Above 5.0 | Below 2.0 | Below 2.00 | Above 15 |
| Regular grade coke (for general purposes) | 1.8–3.0 | 4.1–4.4 | Around 2.10 | |
| Regular grade coke (for electrodes) | 1.2–1.8 | 4.4–4.8 | Above 2.15 | 9.5–12 |
| Premium grade coke | 1.0–1.2 | 4.5–5.0 | Above 2.15 | 8–9.5 |
| High-crystalline coke | Below 1.0 | Around 5.0 | Above 2.15 | Below 8.0 |

(1)measured on an extruded graphite artefact and in the direction parallel to the extrusion.
(2)measured on a calcined coke.
(3)measured on a calcined coke.
(4)measured on an extruded graphite artefact.

The degree of graphitization, h/w, is calculated by the following formula:

h/w=height of [002] peak/[002] peak width at half intensity

The [002] peak was measured on a sample of coke which was prepared by calcining the green coke at 1450° C. by X-ray analysis under the following conditions:

| | |
|---|---|
| Target: | CuKa (Filter: Nickel) |
| Voltage and Current: | 30 KVP; 20mA |
| Current Voltage: | Proportional Counter, 1450 V |
| Count Full Scale: | 10000 c/s to 20000 c/s |
| Time Constant: | 2 sec. |
| Slit: | Divergence 1°; Receiving Slit: 0.15 mm |
| Scanning Speed: | 1°/min. |
| Chart Scanning speed: | 2 cm/min. |

The sample for the measurement of X-ray diffraction was prepared by the following procedure: The calcined coke was pulverized and sieved out 350 mesh plus. A certain amount of this coke flour was put into an aluminium mount (15 mm in length×20 mm in width×1.5 mm in thickness), pressed under a given pressure and then used for the measurement.

The coefficient of thermal expansion was measured on an extruded graphite artefact prepared from the coke by the following procedure: The calcined green coke was pulverized into particle size fractions of 35–65 mesh and 100 mesh plus, the mesh size being Tyler standard sieve size. The coke grist used in making the test artefact contained 40 parts of the former fraction and 60 parts of the latter fraction. One hundred (100) parts of the coke composite and 30 parts of coal tar pitch were well mixed and the mixture was extruded through a hydraulic extruder to form a green extruded rod of 20 mm in diameter. The green extrudate was packed in carbon powder and slowly baked to form a baked artefact. The baking schedule consisted of increasing the temperature in linear fashion to 1000° C. over a period of 8 hours and keeping that temperature for 3 hours. Graphitization of the artefact was carried out in a graphite tube resistance furnace at 2700° C. for 0.5 hours.

The non-crystalline coke corresponds to "hard carbon" so-called, such as charcoal and activated carbon and as far as we know such a type of coke has not been obtained from a petroleum origin. Most of petroleum cokes and pitch cokes which are generally called "soft carbon" fall within the class of regular grade ones and the premium grade coke is rather a special class for petroleum cokes and the high-crystalline coke is much more rare. Even in the production of premium grade coke from a feestock of petroleum origin, it was necessary to solve various difficulties involving the purification of feedstock and coke-forming conditions.

It is apparent to the skilled in the art that in order to obtain a high-crystalline coke from a petroleum feedstock containing a substantial amount of non-crystalline carbon-forming substances (hereinafter referred to as non-crystalline substances), complete and efficient removal or deactivation of the non-crystalline substances is necessary. Therefore, many attempts have been made for this purpose, but no economical success has been achieved as yet. Thus, a heat-treatment of the petroleum starting material was ineffective for the removal or deactivation of non-crystalline substances. Incorporation of an oil or tar containing little or no such non-crystalline substances into the starting material would really result in lowering the concentration of non-crystalline substances, but no appreciable improvement in the crystallinity of coke was obtained possibly due to the presence of non-crystalline substances yet even in lower concentrations. For example, the process proposed by R. C. Hackley in U.S. Pat. No. 2,922,755 wherein a petroleum-derived chargestock comprising a highly aromatic thermal tar and about 10 to 30% by weight of a virgin reduced crude is subjected to coking conditions of temperature and pressure could not be applied successfully to starting materials containing a substantial amount of non-crystalline substances for the purpose of producing a premium grade coke.

Previous treatment, such as extraction and distillation, of starting materials containing a substantial amount of non-crystalline substances also gave no substantial improvement in the crystallinity of coke.

A process wherein a heavy petroleum residuum is heat-treated in the presence or absence of a catalyst, then a part of the residuum thus heat-treated is removed by filtration, distillation, centrifugation, extraction and the like and thereafter the residuum remained is subjected to delayed coking, typically one proposed by F. L. Shea in U.S. Pat. No. 2,775,549, was effective to a certain extent, but still insufficient, for the complete removal of non-crystalline substances, thus resulting in the formation of not a premium grade, but a regular grade coke at most if the starting material used contains a substantial amount of non-crystalline substances.

A variant of the last-mentioned process proposed by H. E. Keel in U.S. Pat. No. 3,617,480 which is characterized in that the heat-treatment of the starting petroleum residuum is effected by a delayed coking operation was also still insufficient, when applied to a petroleum residuum containing a substantial amount of non-crystalline substances, for the selective removal of the non-crystalline substances in the said first coking stage, possibly due to the coprecipitation of crystalline carbon-forming substances with non-crystalline ones in the form of a coke occurring in the first coking stage and also due to the contamination, with non-crystalline substances, of uncoked product in that stage which is to be coked subsequently in the second stage to form a premium grade coke, thus inevitably bringing the lowering in both the yield and quality of the coke obtained in the second coking stage. Similar disadvantages would be more or less unavoidable in other two-stage delayed coking processes for petroleum starting materials as, for example, proposed by D. F. Cameron in U.S. Pat. No. 3,472,761 and H. O. Folkins in U.S. Pat. No. 3,769,200 when starting materials used contain a substantial amount of non-crystalline substances.

The process of Cameron above-referred to, which relates to simultaneous production of two grades, regular and premium grades, on petroleum coke, further suggests that a coking feed to produce a premium grade coke should consist predominantly of a thermal tar such as one from a thermal cracker operating on gas oil from coking zone which is called "a pressure thermal tar" and that a coking feed derived directly from a reduced crude and the like may only produce a regular grade coke and is in no way suited for a premium grade coke.

As outlined above, it was very difficult to achieve economically the complete and efficient removal of non-crystalline substances from materials from which a premium grade or more highly crystalline coke should be produced, and as far as we know there has been established no process suited for a commercial large-scale production of a high-crystalline coke starting from a petroleum feedstock containing a substantial amount of non-crystalline substances.

BRIEF SUMMARY OF THE INVENTION

It is the primary object of this invention to provide a new, simple process for producing a petroleum coke of high-crystalline grade in a high yield at reasonable cost from a wide variety of petroleum materials including those from which a premium grade coke could never been obtained in the prior art.

We have made many studies on the removal of non-crystalline substances from petroleum feedstocks for the production of premium grade or higher grade coke and now successfully established a new process for the production of a high-crystalline coke by taking such steps before delayed coking that the feedstock is first heated in a tube heater and made to stay therein under certain limited conditions for certain period of time thereby to effect cracking and soaking of the feedstock and then subjected to a flash-distillation under certain limited conditions thereby to remove selectively non-crystalline substances contained in the feedstock as pitch to provide a refined heavy oil satisfactorily suited as material for the delayed coking intended.

According to the present invention, therefore, we provide a process for producing a high-crystalline petroleum coke from a petroleum feedstock which comprises the steps of:

(1) heating the petroleum feedstock in a tube heater to a temperature of 430°–520° C. under a pressure of 4–20 $Kg/cm^2G$;

(2) maintaining the feedstock in the tube heater at that temperature for further 30–500 seconds, preferably 200–500 seconds, to effect cracking and soaking thereof;

(3) introducing the feedstock thus heat-treated into a high-temperature flashing column, where a flash-distillation is effected at a temperature of 380°–480° C. under a pressure of 0–2 Kg/cm$^2$G;

(4) continuously removing non-crystalline substances contained in the feedstock as pitch from the bottom of the flashing column;

(5) fractionating in a fractionating column the distillate from the flashing column into cracked gas, gasoline, gas oil and heavy residue; and (6) introducing the heavy residue, after heating to a temperature required for the subsequent delayed coking, into a coking drum, where it is subjected to delayed coking at a temperature of 430°–460° C. under a pressure of 4–20 Kg/cm$^2$G for at least 20 hours, preferably at least 30 hours, thereby forming a high-crystalline petroleum coke having a coefficient of thermal expansion in the direction parallel to the extrusion of less than $1.0\times10^{-6}$/°C. over 100°–400° C. when measured in the form of an extruded graphite artefact thereof.

In this process, the steps (1) to (5) are of a pre-treatment of the feedstock to be subjected to a delayed coking in the step (6) and therefore referred to hereinafter as the first stage of the process as a whole, the step (6) being the second stage of the process.

DETAILED DESCRIPTION OF THE INVENTION

The first stage of the process of this invention was arranged as a result of our minute study on the relation in coking reaction between (1) feedstock and reaction conditions including temperature, pressure and time and (2) yield and properties of coke formed, from which was derived such discovery that non-crystalline substances contained in the petroleum feedstocks can be efficiently removed as pitch by taking a previous treatment comprising heating a petroleum feedstock containing a substantial amount of non-crystalline substances in a tube heater to a temperature of 430°–520° C. under a pressure of 4–20 Kg/cm$^2$G, maintaining the feedstock therein at that temperature for further 30–500 seconds, preferably 200–500 seconds, to effect cracking and soaking thereof and then subjecting the feedstock thus heat-treated to a flash distillation at a temperature of 380°–480° C. under a pressure of 0–2 Kg/cm$^2$G. The pitch removed from the flash-distillation step may, if desired, be subjected to a delayed coking operated at a temperature of 410°–430° C. under a pressure of 2–10 Kg/cm$^2$G to produce another coke. The coke thus obtained in a high yield (50–70% by weight) has appearance and texture like or close to amorphous carbon such as charcoal and activated carbon particularly when the feedstock contains a large amount of non-crystalline substances. This clearly suggests that the removal or separation of the non-crystalline substances from the petroleum feedstock was achieved very efficiently and economically by the adoption of the first stage of the process of this invention. The distillate thus obtained from the high temperature flash distillation is substantially free from such non-crystalline substances as a result of the selective and efficient removal thereof and therefore the heavy residual oil derived from the said distillate by subjecting it to fractionation to remove lighter fractions is satisfactorily suited as feedstock for the production of a high-crystalline coke. Thus, the heavy residual oil, when subjected to a delayed coking at a temperature of 430°–460° C. under a pressure of 4–20 Kg/cm$^2$G, gives a high-crystalline coke which has a degree of crystallinity significantly higher than that of premium-grade coke so called and which is in higher yield.

It appears to be quite unexpected from the relevant prior art teachings, particularly for example from Cameron's teaching that the use of a coking feed consisting predominantly of a "pressure" thermal tar derived from thermal cracking of a coker gas oil is essential for the production of a premium grade petroleum coke, that a special preheat-treatment followed by a high-temperature flashing for the removal of non-crystalline substances as pitch according to this invention could provide a coker feed suited by itself for the production of a high-crystalline coke from a wide variety of petroleum materials, most typically from a reduced crude containing a large amount of non-crystalline substances.

The petroleum feedstock usable in the process of this invention may be selected from the group consisting of a virgin crude oil having a sulfur content of 0.4% by weight or less, a distillation residue derived from the crude oil, a cracked residue having a sulfur content of 0.8% by weight or less, a hydrodesulfurized product having a sulfur content of 0.8% by weight or less of any residue from a distillation or cracking of petroleum and a mixture thereof. The sulfur content of the petroleum feedstock is important if the high-crystalline coke obtained is to be used for making graphite electrodes in view of a detrimental effect of sulfur to the mechanical strength of the electrodes.

Even when a residue from a cracking is used as petroleum feedstock, it is necessary for the production of a high-crystalline coke to take the first stage of the process of this invention prior to the delayed coking stage. As taught by Cameron above-referred to, a thermal tar such as "pressure" thermal tar derived from a thermal cracking of a coker gas oil would produce a premium grade coke by a conventional delayed coking, but was impossible to give a high-crystalline coke unless the special preheat treatment followed by flashing of this invention was applied thereto before the delayed coking thereof. With respect to the use of a high-temperature thermal tar derived from a higher temperature thermal cracking of naphtha or gas oil for the purpose of producing ethylene and other unsaturated hydrocarbons, it is well-known that such a high-temperature thermal tar alone cannot suit even for the production of a premium grade coke. Thus, the prior art suggests for the production of a premium grade coke from such a high-temperature thermal tar the blending of the thermal tar with a reduced crude or a fraction thereof, application of a higher coking pressure, incorporation of a diluent fraction into the thermal tar and the like (see Noguchi, et al., U.S. Pat. No. 3,547,807 and Furuhashi, et al., Japanese Patent Publication No. 41221/71).

Therefore, it will be evident that the process of this invention is quite unique and advantageous over the prior art processes in such point that it gives not a premium grade but a higher grade, namely a high-crystalline coke having a value of CTE (in the direction parallel to the extrusion) of less than $1.0\times10^{-6}$/°C. over 100°–400° C. in economical and efficient way, details of which will be illustrated later.

BRIEF DESCRIPTION OF THE DRAWING

The drawing shows a simplified schematic flow diagram of a representative embodiment of this invention.

DESCRIPTION OF THE PREFERRED EMBODIMENT

Referring to the drawing, 2 is a tube preheater for effecting the preheat treatment according to this invention, 3 is a flashing column, 7 is a gas-liquid separator, 8 is a main column, 11 is a coking preheater, 12 and 13 are coking drums of delayed type, 17 is a condenser for the main column 8 and 18 is a receiver. The gas-liquid separator 7 may be optional.

The petroleum feedstock is introduced into the tube preheater 2 through line 1. In the preheater, the feedstock is heated to a temperature of 430°–520° C. under a pressure of 4–20 Kg/cm$^2$G and maintained at that temperature for further 30–500 seconds during which time cracking and soaking of the feedstock are effected. The feedstock thus heat-treated is introduced into the flashing column 3 where it is subjected to flash distillation. At the bottom of the flashing column 3 a heating medium 4 is circulated to keep the bottom temperature at 410°–430° C., thereby 410°–430° C. heavy fraction of the heat-treated feedstock is discharged from line 6 through a valve 5 as pitch. The distilate free from the pitch in the flashing column 3 is introduced into the main column 8 through lines 24 and 25. If the operating conditions of the preheater 2 become so severe that one-through pass of the feedstock to the preheater 2 is insufficient for effecting the intended heat-treatment or otherwise that the blockage of the tube heater is unavoidable, the operation of the preheat-treatment may be modified in such a manner that the gas-liquid separator 7 into which is introduced the distillate free from the pitch through line 23 is provided between the flashing column 3 and the main column 8 as shown in the drawing to effect the condensation of a part of the preheated feedstock from which pitch has been removed and to recycle the condensate through line 9 to the inlet of the preheater 2 as combined feed, thus making the intended preheat-treatment complete under reasonable operating conditions of the preheater 2. The flashing column 3 is provided with a demister 22 to avoid the introduction into the main column of foreign and undesirable substances by entrainment with the distillate. The feedstock introduced into the main column 8 through lines 24 and 25 is fractionated into gas, gasoline, gas oil fractions, leaving a heavy residue which is withdrawn from the bottom of the column 8 as combined feed which is a mixture with a recycle oil derived from coking drum 12 or 13 through line 26 and then passed through line 10 to coking preheater 11. The preheated feedstock is charged through switch valve 14 into a delayed coking drum 12 or 13, alternately, where it is coked at 430°–460° C. under 4–20 Kg/cm$^2$G. The coke drum overhead discharged through switch valve 15 is returned to the main column 8 through line 26, where it is similarly fractionated as above into gas, gasoline, gas oil and recycle oil. The gas and gasoline are discharged at the top of column 8 through line 16, cooled in a condenser 17 and sent to the receiver 18, from which the condensed gasoline was withdrawn at the bottom thereof and sent partly through line 20 for any desired application and partly through line 19 for recycling to the main column 8 as reflux, and the gas was discharged at the top thereof through line 21. The recycle oil was withdrawn at the bottom of the main column 8 through line 10 as above-mentioned in admixture with the fresh coker feed and again introduced through the coking preheater into the coking drum 12 or 13. The gas oil was discharged from the main column 8 at an intermediate plate through line 27 for desired applications.

The coking drums 12 and 13 are alternately used for the delayed coking operation by switching over every 36 hours. While one is in operation, another is under discharging the coke formed and then under standing by.

The following Examples further illustrate, but not limit, this invention, in which percentages are by weight unless otherwise stated.

EXAMPLE 1

(1) A topped residue of Minas crude oil (the properties of which being shown in Table 2) was used as feedstock for this Example. The feedstock was introduced into a stainless steel tube heater having 4 mm inside diameter, 6 mm outside diameter and 40 m length which was externally heated by a heating medium and heated under 20 Kg/cm$^2$G to 480° C. and maintained at this temperature for about 190 seconds. The feedstock thus heat-treated was introduced at the middle part of a high-temperature flashing column having 100 mm diameter and 1000 mm height which was externally heated by electric wire heater and subjected to flash distillation under conditions of 400° C. and 0 Kg/cm$^2$G to recover distillate as overhead and to withdraw pitch at the bottom of column in an amount of 10.7% based on the feedstock, with a retention time of about 15 minutes at that bottom, together with gas generated in an amount of 21.0% on the same basis. The overhead from the flashing column was fractionated in a fractionator having 100 mm diameter to give cracked gas, gasoline, gas oil and heavy residue boiling 300° C.+. The heavy residue thus obtained in the yield of 54.3% based on the feedstock was passed through a tube heater having inside and outside diameters of 4 mm and 6 mm, respectively, to preheat to the temperature required for the subsequent coking and charged into a coking drum where it was subjected to delayed coking at 435° C. under 9.0 Kg/cm$^2$G for 38 hours, yielding 7.4% of coke based on the charge (4.0% based on the starting feedstock). By-products of the coking were 22.1% gas (12.0%), 19.0% gasoline boiling up to 200° C. (10.0%), 23.0% gas oil boiling in the range 200°–300° C. (12.5%) and 28.5% heavy oil boiling 300° C.+ (15.5%).

The properties of coke thus obtained are shown in Table 3. The coke was classified under high-crystalline grade.

(2) By way of comparison, the Minas topped residue same as that used in (1) above was heated in a tube heater and, as soon as it reached a temperature of 430° C., introduced into a distillation column, where a distillation was effected under vacuum to give a vacuum distillate (540° C.+ at atmospheric pressure) in 62% yield. The distillate was passed through a tube heater to preheat it to the coking temperature required and charged into a coking drum where it was subjected to delayed coking at 435° C. under 9 Kg/cm$^2$G for 38 hours in the same manner as that used in (1) above, yielding 1.8% of coke based on the charge (1.1% based on the topped residue). The coke had a value of CTE over 100°–400° C. of $1.35\times10^{-6}$/°C. which was classified under regular grade.

(3) By way of further comparison, a gas oil fraction (boiling range 250°-350° C.) derived from the vacuum distillation conducted in (2) above in 18% yield was taken and subjected to thermal cracking at 540° C. under 50 Kg/cm$^2$G to yield a thermal tar in 29.9% yield based on the gas oil. The thermal tar was passed through a tube heater to preheat it to the coking temperature required and charged into a coking drum where it is subjected to delayed coking in the same manner and under the same conditions as those used in (1) above. The coke thus obtained had a value of CTE over 100°-400° C. of $1.18\times10^{-6}$/°C. which was classified under premium grade.

EXAMPLE 2

(1) Djatibarang virgin crude oil (the properties of which being shown in Table 2) was used as feedstock for this Example.

The feedstock was introduced into a stainless steel tube heater having 4 mm inside diameter, 6 mm outside diameter and 40 m length which was externally heated by a heating medium, heated under 20 Kg/cm$^2$G to 480° C. and maintained at this temperature for about 230 seconds. The feedstock thus heat-treated was introduced at the middle part of a high-temperature flashing column having 100 mm diameter and 100 mm height which was externally heated by electric wire heater, where the flash distillation of the feedstock was effected at 400° C. under 0 Kg/cm$^2$G to recover distillate as overhead and to withdraw pitch at the bottom of column in an amount of 12.0% based on the feedstock, with a retention time of about 5 minutes at that bottom, together with gas generated in an amount of 10.0% on the same basis. The distillate was then passed through a tube heater having 4 mm inside diameter and 6 mm outside diameter to preheat to the temperature required for the subsequent coking and charged into a coking drum, where it was subjected to delayed coking at 435° C. under 9.0 Kg/cm$^2$G for 24 hours, yielding 10.1% of coke based on the charge (7.9% based on the feedstock). By-products of the coking were 9.8% gas (7.6%), 22.4% gasoline boiling up to 200° C.(17.5%), 48.1% gas oil (37.5%) and 9.6% heavy oil boiling 300° C.+ (7.5%).

The properties of coke obtained above are shown in Table 3. The coke was similarly classified under high-crystalline grade.

(2) The same Djatibarang virgin crude oil as that used in (1) above was subjected to the preheat treatment under the conditions of 20 Kg/cm$^2$G, 500° C. and 200 seconds. The feedstock thus heat-treated was introduced at the middle part of a high temperature flashing column operating at 420° C. under 0 Kg/cm$^2$G to recover distillate as overhead and to withdraw pitch at the bottom of the column in an amount of 11.2% based on the feedstock. The overhead from the flashing column was fractionated in the fractionator same as that used in Example 1 to give cracked gas, gasoline, gas oil and heavy residue boiling 300° C+. The heavy residue thus obtained in a yield of 60.6% based on the feedstock was passed through a tube heater used in (1) above to preheat to the temperature required for the subsequent coking and charged into a coking drum where it was subjected to delayed coking at 435° C. under 9 Kg/cm$^2$G for 24 hours, yielding 18.2% of coke based on the charge (11.0% based on the starting feedstock). By-products of the coking were 20.5% gas (12.4%), 21.0% gasoline boiling up to 200° C. (12.7%), 23.9% gas oil boiling in the range of 200°-300° C. (14.5%) and 16.5% heavy oil boiling 300° C.+ (10.0%).

The properties of coke thus obtained are shown in Table 3. The coke was also classified under high-crystalline grade.

EXAMPLE 3

(1) A thermal tar named as tar-bottom obtained as by-product in a conventional thermal cracking of gas oil for the purpose of producing ethylene which has sulfur content of 0.76% (the properties of which being shown in Table 2) was used as feedstock for this Example.

The feedstock was introduced into a stainless steel tube heater having 4 mm inside diameter, 6 mm outside diameter and 20 m length which was externally heated by a heating medium, heated under a pressure of 4 Kg/cm$^2$G to 450° C. and maintained at this temperature for about 260 seconds. The feedstock was then introduced at the middle part of a high-temperature flashing column having 100 mm diameter and 100 mm height which was externally heated by electric wire heater, where the flash distillation of the feedstock was effected at 450° C. under 0 Kg/cm$^2$G to recover distillate as overhead and to withdraw pitch at the bottom of column in an amount of 24.6% based on the feedstock, with a retention time of about 10 minutes at the bottom of column, together with gas generated in an amount of 5% on the same basis. The distillate was then passed through a tube heater having inside and outside diameters of 4 mm and 6 mm, respectively, to preheat to the temperature required for the subsequent coking and charged into a coking drum, where it was subjected to delayed coking at 435° C. under 9.0 Kg/cm$^2$G for 38 hours, yielding 28.5% of coke based on the charge (20.0% based on the feedstock). By-products of the coking were 11.5% gas (8.1%), 25.4% gasoline boiling up to 200° C. (17.9%), 28.9% gas oil boiling in the range 200°-300° C. (20.3%) and 5.7% heavy oil boiling 300° C.+ (4.0%).

The properties of coke obtained above are shown in Table 3. The coke was clearly classified under highcrystalline grade.

(2) By way of comparison, the same thermal tar as used in (1) above was directly passed through a tube heater same as that used in (1) above as coker preheater thereby preheat the tar to the temperature required for the subsequent coking and charged into a coking drum, where it was subjected to delayed coking at 435° C. under 9.0 Kg/cm$^2$G for 38 hours. The coke thus obtained had a value of CTE over 100°-400° C. of $1.41\times10^{-6}$/°C. which was classified under regular grade.

EXAMPLE 4

A thermal tar named as ethylene-bottom obtained as by-product in a conventional thermal cracking of naphtha for the purpose of producing ethylene, having sulfur content of 0.02% (the properties of which being shown in Table 2) was used as feedstock for this Example.

The feedstock was introduced into a stainless steel tube heater same as that used in Example 3 and heated under a pressure of 4 Kg/cm$^2$G to 430° C. and maintained at this temperature for about 260 seconds. The feedstock thus heat-treated was introduced at the middle part of a high-temperature flashing column same as that used in Example 3 and subjected to flash distillation under conditions of 400° C. and 0 Kg/cm$^2$G to recover distillate as overhead and to withdraw pitch at the bottom of column in an amount of 18.2% based on the feedstock, with a retention time of about 10 minutes at that bottom, together with gas generated in an amount of 2.6% on the same basis.

The overhead from the flashing column was fractionated in a fractionator to give 2.8% gas, 1.8% gasoline, 17.6% gas oil and 59.6% heavy residue based on the feedstock. The heavy residue was passed through the tube heater same as that used in Example 3 to preheat to the temperature required for the subsequent coking and charged into a coking drum where it was subjected to delayed coking at 435° C. under 9.0 Kg/cm$^2$G for 38 hours, yielding 28.7% of coke based on the coker charge (17.1% based on the feedstock). By-products of the coking were 7.4% gas (4.4%), 21.8% gasoline boiling up to 200° C. (13.0%), 27.9% gas oil boiling in the range 200°-300° C. (16.6%) and 14.3% heavy oil boiling 300° C.+ (8.5%).

The properties of coke thus obtained are shown in Table 3. The coke was similarly classified under high-crystalline grade.

EXAMPLE 5

(1) A hydrodensulfurized product containing 0.16% of sulfur from a topped residue of Kuwait crude oil (the properties of which being shown in Table 2) was used as feedstock for this run.

The feedstock was introduced into the tube heater having 4 mm inside diameter, 6 mm outside diameter and 20 m length which was externally heated by a heating medium and heated under a pressure of 4 Kg/cm$^2$G to 500° C. and maintained at this temperature for about 230 seconds. The feedstock thus heat-treated was introduced at the middle part of the flashing column same as that used in Example 1 and subjected to flash distillation under conditions of 480° C. and 0 Kg/cm$^2$G to withdraw pitch at the bottom of the column in an amount of 5.5% based on the feedstock. The overhead of the flashing column was subjected to distillation to recover lighter fractions and to provide a bottom residue boiling 300° C.+ in an amount of 58.7% based on the feedstock.

The residue was passed through the tube heater into the coking drum same as those used in Example 1 and coked therein in the same manner and under the same conditions as those used in Example 1, yielding 11.6% of coke based on the coker charge (6.8% based on the feedstock).

The properties of coke thus obtained are shown in Table 3. The coke was similarly classified under high-crystalline grade.

(2) A mixture of 6 parts by weight of the hydrodesulfurized residue same as that used in the run (1) above and 1 part by weight of the "ethylene bottom" thermal tar same as that used in Example 4 was used as feedstock for this run.

The feedstock was subjected to heat treatment and flash distillation in the same manner and under the same conditions as those used in the run (1) above with the removal of 1.5% pitch based on the feedstock.

The overhead of the flashing column was distilled to provide a bottom residue boiling 300° C.+ in an amount of 70.2% based on the feedstock.

The residue was then coked in the same manner and under the same conditions as those used in Example 1, yielding 13.5% of coke based on the coker charge (9.5% based on the feedstock).

The properties of coke are shown in Table 3. The coke was similarly classified under high-crystalline coke.

EXAMPLE 6

A hydrodesulfurized product containing 0.3% of sulfur from a cracked residue named as desulfurized tar which was obtained by hydrodesulfurizing the latter obtained as by-product in a conventional thermal cracking of gas oil for the purpose of producing ethylene (the properties of which being shown in Table 2) was used as feedstock for this Example.

The feedstock was introduced into a stainless steel tube heater having 4 mm inside diameter, 6 mm outside diameter and 30 m length which was externally heated by a heating medium, heated under 20 Kg/cm$^2$G to 490° C. and maintained at this temperature for about 250 seconds. The feedstock was then introduced at the middle part of a high-temperature flashing column having 100 mm diameter and 1000 mm height which was externally heated by electric wire heater, where the flash distillation of the feedstock was effected at 400° C. under 0 Kg/cm$^2$G to recover distilate as overhead and to withdraw pitch at the bottom of column in an amount of 7.9% based on the feedstock, with a retention time of about 10 minutes at that bottom, together with gas generated in an amount of 1.5% on the same basis. The distillate was then passed through a tube heater having 4 mm inside diameter and 6 mm outside diameter to preheat to the temperature required for the subsequent coking and charged into a coking drum, where it was subjected to delayed coking at 435° C. under 9.0 Kg/cm$^2$G for 38 hours, yielding 10.9% of coke based on the charge (9.9% based on the feedstock). By-products of the coking were 8.6% gas (7.8%), 5.0% gasoline boiling up to 200° C. (4.5%), 50.4% gas oil (45.7%) and 25.1% heavy oil boiling 300° C.+ (22.7%).

The properties of coke thus obtained are shown in Table 3, which clearly show that the coke is of high-crystalline grade.

Table 2

| | Minas topped residue (Example 1) | Djatibarang virgin crude oil (Example 2) | Tar-bottom (Example 3) | Ethylene-bottom (Example 4) | Hydrodesulfurized residue (Example 5) | Desulfurized tar (Example 6) |
|---|---|---|---|---|---|---|
| Specific gravity (15°/4° C.) | 0.883 | 0.885 | 1.0825 | 1.0684 | 0.8985 | 1.028 |
| Carbon residue (wt. %) | 4.5 | 8.9 | 17.7 | 12.8 | 2.9 | 6.7 |
| Sulfur content (wt. %) | 0.22 | 0.17 | 0.76 | 0.02 | 0.16 | 0.3 |
| Wax content(wt. %) | 36.8 | 33.6 | — | — | — | — |
| Pour point (°C.) | 47.5 | +45 | +20 | −12.5 | +17.5 | <−30 |
| Composition(%) | | | | | | |
| Paraffin content | 64.1 | 62.0 | 5.6 | 5.6 | 53.6 | 16.5 |
| Aromatics content | 31.0 | 24.6 | 88.7 | 81.7 | 42.8 | 81.3 |

Table 2-continued

| | Minas topped residue (Example 1) | Djatibarang virgin crude oil (Example 2) | Tar-bottom (Example 3) | Ethylene-bottom (Example 4) | Hydrode-sulfurized residue (Example 5) | Desulfurized tar (Example 6) |
|---|---|---|---|---|---|---|
| Resin content | 0.5 | 0.5 | 1.5 | 0.7 | 0.7 | 0.6 |
| Residue | 4.4 | 12.9 | 4.2 | 12.0 | 2.9 | 1.6 |
| Distillation | | | | | | |
| I.B.P. (°C.) | | 95 | 220 | 212 | 235 | 195 |
| 5% | | 180 | 245 | 224 | 275 | 237 |
| 10% | | 240 | 260 | 227 | 305 | 250 |
| 50% | | 369 | 345 | 313 | 418 | 324 |
| 90% | | — | — | — | — | — |
| E.P. | | 378 | 465 | 485 | 510 | 513 |
| (Distillate %) | | (65%) | (88%) | (79%) | (78%) | (85%) |

Table 3

| | Example 1(1) | Example 1(2)* | Example 1(3)* | Example 2(1) | Example 2(2) | Example 3(1) | Example 3(2)* | Example 4 | Example 5 (1) | Example 5 (2) | Example 6 |
|---|---|---|---|---|---|---|---|---|---|---|---|
| Graphite artefact | | | | | 2700° C. × 0.5 hr | | | | | | |
| Graphitization condition | | | | | | | | | | | |
| Coefficient of thermal expansion (CTE) (in the direction parallel to the extrusion | | | | | | | | | | | |
| RT-125° C. (× $10^{-6}$/°C.) | 0.35 | 0.66 | 0.46 | 0.40 | 0.33 | 0.40 | 0.62 | 0.33 | 0.35 | 0.18 | 0.19 |
| 100-400° C. (× $10^{-6}$/°C.) | 0.98 | 1.35 | 1.18 | 0.88 | 0.91 | 0.99 | 1.41 | 0.83 | 0.91 | 0.83 | 0.71 |
| Coefficient of cubic expansion | | | | | | | | | | | |
| 130-300° C. (× $10^{-6}$/°C.) | 7.70 | 10.2 | 9.19 | 7.85 | 7.61 | 7.88 | 9.23 | 7.65 | 7.18 | 6.93 | 7.66 |
| Electric resistivity (× $10^{-3}$ Ω cm) | 0.82 | 1.65 | 1.27 | 0.80 | 0.87 | 0.83 | 1.52 | 0.85 | 1.141 | 0.980 | 0.865 |
| Calcined coke | | | | | 1400° C. × 3 hr. | | | | | | |
| Calcination condition | | | | | | | | | | | |
| Crushing strength (%) | | 57.1 | | 65.0 | 61.5 | 56.7 | | 64.0 | 65.8 | 66.2 | 65.3 |
| Real density (g/cc) | | 2.154 | | 2.147 | 2.165 | 2.152 | | 2.158 | 2.158 | 2.160 | 2.154 |
| Water content (wt. %) | | 0.04 | | 0.07 | 0.05 | 0.05 | | 0.05 | 0.03 | 0.03 | 0.18 |
| Ash content (wt. %) | | 0.05 | | 0.06 | 0.03 | 0.05 | | 0.05 | 0.23 | 0.07 | 0.06 |
| Volatile matter content (wt. %) | | 0.22 | | 0.25 | 0.87 | 0.20 | | 0.28 | 0.21 | 0.33 | 0.16 |
| Fixed carbon content (wt. %) | | 99.69 | | 99.62 | 99.05 | 99.70 | | 99.62 | 99.53 | 99.57 | 99.66 |
| Sulfur content (wt. %) | | 0.24 | | 0.22 | 0.17 | 0.63 | | 0.07 | 0.35 | 0.31 | 0.48 |
| Metal content (wt. ppm) | | | | | | | | | | | |
| Fe | | 20 | | — | — | 28 | | — | — | — | 49 |
| Ni | | 1 | | — | — | 2 | | — | — | — | 4 |
| V | | 2 | | — | — | 1 | | — | — | — | 1 |
| Cu | | 6 | | — | — | 2 | | — | — | — | 1 |

*Comparative Example

What we claim is:

1. A process for producing a high-crystalline petroleum coke from a petroleum feedstock containing a substantial amount of non-crystalline carbon-forming substances which comprises the steps of:

heating petroleum feedstock containing a substantial amount of non-crystalline carbon-forming substances in a tube heater to a temperature of 433°-520° C. under a pressure of 4-20 Kg/cm$^2$G;

maintaining the feedstock in the tube heater at that temperature for further 30-500 seconds to effect cracking and soaking thereof;

introducing the feedstock thus heat-treated into a high-temperature flashing column, and effecting therein flash distillation of said feedstock at a temperature of 380°-480° C. under a pressure of 0-2 Kg/cm$^2$G;

continuously removing non-crystalline substances contained in the feedstock as pitch from the bottom of the flashing column;

fractionating in a fractionating column the distillate from the flashing column into cracked gas, gasoline, gas oil and heavy residue; and introducing the heavy residue, after heating to a temperature required for the subsequent delayed coking, into a coking drum, where it is subjected to delayed coking at a temperature of 430°-460° C. under a pressure of 4-20 Kg/cm$^2$G for at least 20 hours, thereby forming a high-crystalline petroleum coke having a coefficient of thermal expansion in the direction parallel to the extrusion of less than $1.0\times10^{-6}$/°C. over 100°-400° C. when measured in the form of an extruded graphite artefact thereof.

2. A process as claimed in claim 1 wherein said feedstock comprises a member selected from the group consisting of a virgin crude oil having a sulfur content of 0.4% by weight or less, a distillation residue derived from the crude oil, a cracked residue having a sulfur content of 0.8% by weight or less, a hydrodesulfurized product having a sulfur content of 0.8% by weight or less of any residue from a distillation or cracking of petroleum and a mixture thereof.

3. A process as claimed in claim 2 wherein the distillation residue is a topped residue of a crude oil having a sulfur content of 0.4% by weight or less.

4. A process as claimed in claim 2 wherein the distillation residue is a vacuum distillation residue of a crude oil having a sulfur content of 0.4% by weight or less.

5. A process as claimed in claim 1 wherein the time for which the delayed coking is carried out is at least 30 hours.

6. A process as claimed in claim 1 wherein said petroleum feedstock is heated to a temperature of from 450°-520° C. and wherein the time during which the feedstock is maintained in the tube heater at 450°-520° C. is 30-500 seconds.

7. A process as claimed in claim 6 wherein the time during which the feedstock is maintained in the tube heater at 450°-520° C. is 190-500 seconds.

8. A process as claimed in claim 6 wherein the time during which the feedstock is maintained at 450°-520° C. is 200-500 seconds.

9. A process for producing high-crystalline petroleum coke from a petroleum feedstock containing a substantial amount of non-crystalline carbon-forming substances which comprises the steps of:

heating petroleum feedstock containing a substantial amount of non-crystalline carbon-forming substances in a tube heater to a temperature of 430°-520° C. under a pressure of 4-20 $Kg/cm^2G$;

maintaining the feedstock in the tube heater at that temperature for further 190-500 seconds to effect cracking and soaking thereof;

introducing the feedstock thus heat-treated into a high-temperature flashing column, and effecting therein flash distillation of said feedstock at a temperature of 380°-480° C. under a pressure of 0-2 $Kg/cm^2G$;

continuously removing non-crystalline substances contained in the feedstock as pitch from the bottom of the flashing column;

fractionating in a fractionating column the distillate from the flashing column into cracked gas, gasoline, gas oil and heavy residue; and introducing the heavy residue, after heating to a temperature required for the subsequent delayed coking, into a coking drum, where it is subjected to delayed coking at a temperature of 430°-460° C. under a pressure of 4-20 $Kg/cm^2G$ for at least 20 hours, thereby forming a high-crystalline petroleum coke having a coefficient of thermal expansion in the direction parallel to the extrusion of less than $1.0\times10^{-6}$/°C. over 100°-400° C. when measured in the form of an extruded graphite artefact thereof.

10. A process as claimed in claim 9 wherein the time during which the temperature of the feedstock is maintained in the tube heater at 430°-520° C. is from 200-500 seconds.

* * * * *